US005753999A

United States Patent [19]

Roozekrans et al.

[11] Patent Number: 5,753,999

[45] Date of Patent: May 19, 1998

[54] LOW-PRESSURE MERCURY VAPOUR DISCHARGE LAMP

[75] Inventors: Christianus J. Roozekrans; Henricus C. G. Verhaar, both of Eindhoven, Netherlands

[73] Assignee: U.S. Philips Corporation, New York, N.Y.

[21] Appl. No.: 516,906

[22] Filed: Aug. 18, 1995

[30] Foreign Application Priority Data

Aug. 25, 1994 [EP] European Pat. Off. ..... 94202435

[51] Int. Cl.[6] ..... H01J 1/62; H01J 63/04

[52] U.S. Cl. ..... 313/489; 313/485; 313/492; 313/493

[58] Field of Search ..... 313/221, 485, 313/489, 490–93, 635, 636, 640; 445/11, 14; 427/106, 126.3; 106/1.05

[56] References Cited

U.S. PATENT DOCUMENTS

| | | | |
|---|---|---|---|
| 3,377,494 | 4/1968 | Repsher . | |
| 3,544,828 | 12/1970 | Bouchard et al. | 313/109 |
| 3,624,444 | 11/1971 | Berthold et al. | 313/221 |
| 3,963,954 | 6/1976 | Milke et al. | 313/489 |
| 4,265,950 | 5/1981 | Graff | 313/485 |
| 4,344,016 | 8/1982 | Hoffmann et al. | 313/489 |
| 4,379,252 | 4/1983 | Work et al. | 313/485 |
| 4,544,997 | 10/1985 | Seuter et al. | 313/489 |
| 4,916,359 | 4/1990 | Jonsson | 313/489 |

*Primary Examiner*—Sandra L. O'Shea
*Assistant Examiner*—Mack Haynes

[57] ABSTRACT

A low-pressure mercury vapour discharge lamp according to the invention comprises a radiation-transmitting, glass discharge vessel which encloses a discharge space in a gastight manner and which is provided with a filling of mercury and a rare gas. The lamp in addition comprises means for maintaining an electrical discharge in the discharge space. An intermediate layer which repels alkali metals and which is made of, for example, silicon oxide lies on a surface of the discharge vessel facing towards the discharge space, which intermediate layer supports a protective layer of at least an oxide of at least one element from the series formed by magnesium, aluminium, titanium, zirconium, and the rare earths, this protective layer being substantially free from particles greater than 1 μm. The lamp according to the invention has a comparatively low mercury consumption.

15 Claims, 1 Drawing Sheet

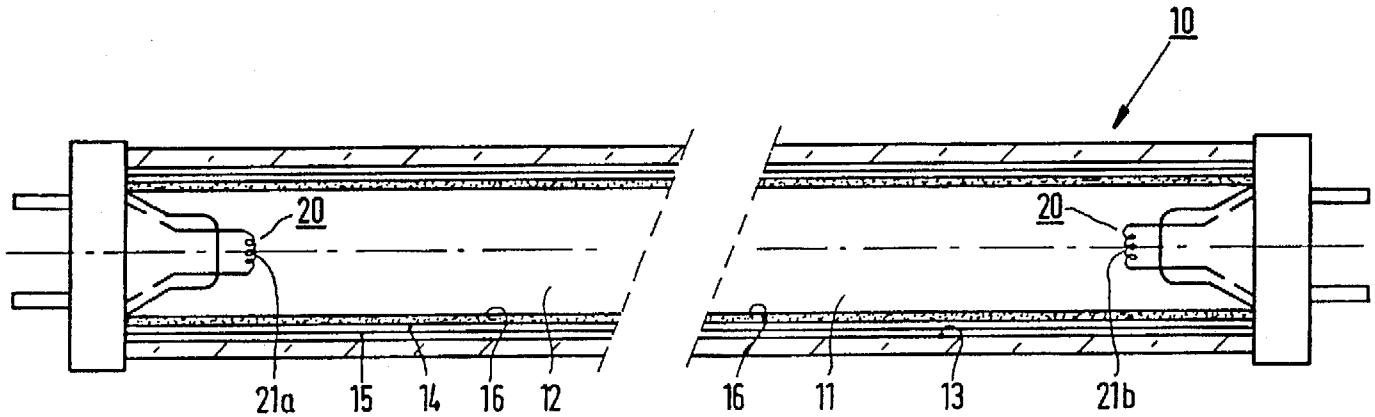
10
20
21b
13
11
16
12
16
14
15
20
21a

LOW-PRESSURE MERCURY VAPOUR DISCHARGE LAMP

The invention relates to a low-pressure mercury vapour discharge lamp comprising a radiation-transmitting glass discharge vessel which encloses a discharge space in a gastight manner and which is provided with a filing of mercury and a rare gas, while a protective layer comprising at least an oxide of at least one element from the series formed by magnesium, aluminium, titanium, zirconium, and the rare earths is provided at a surface of the discharge vessel facing towards the discharge space, which protective layer is substantially free from particles greater than 1 μm, while the lamp further comprises means for maintaining an electrical discharge in the discharge space.

The protective layer counteracts deterioration of the discharge vessel wall caused by interactions with mercury, and thus favourably affects lumen maintenance of the lamp during its life. The term "rare earths" in the present description and claims is understood to cover the elements scandium, yttrium, lanthanum, and the lanthanides. Mercury is capable of passing through a protective layer made up from particles having a diameter greater than 1 μm, thus coming into contact with the wall in spite of the presence of the protective layer.

U.S. Pat. No. 4,544,997 discloses a lamp in which the protective layer is a film-type, substantially closed layer of an oxide of at least one of the elements from the group formed by scandium, yttrium, lanthanum, gadolinium, ytterbium, and lutetium. The protective layer was obtained in that a solution of an organometallic compound was flushed over the inner surface of the discharge vessel and the film remaining behind on the inner surface after flushing was dried and sintered.

It was found in known low-pressure mercury vapour discharge lamps that the quantity of mercury available for lamp operation decreased comparatively quickly. Although the decrease in the available quantity of mercury, also called mercury consumption hereinafter, in lamps provided with a protective layer is relatively small in comparison with other known low-pressure mercury lamps, a comparatively high mercury dose is still necessary for the lamp known from the cited U.S. patent for realising a sufficiently long lamp life. This is bad for the environment in the case of inexpert handling at the end of lamp life.

A high mercury dose moreover impedes an economically justifiable use of mercury doped with $^{196}$Hg. It is known from U.S. Pat. No. 4,379,252 that a lamp whose mercury filling is doped with this isotope has a comparatively high luminous efficacy. Since this isotope is comparatively expensive, however, this advantage disappears in the case of a high mercury dose owing to the cost price of the quantity of the isotope required for this dose.

It is an object of the invention to provide a lamp of the kind mentioned in the opening paragraph which consumes comparatively little mercury.

According to the invention, the lamp is for this purpose characterized in that an intermediate layer which repels alkali metals is present between the surface of the discharge vessel facing towards the discharge space and the protective layer.

The inventors have found that mercury is lost during lamp life in the known lamp, with exclusively a protective layer, inter alia in that alkali metals such as sodium and potassium originating from the glass wall diffuse through the protective layer and subsequently form amalgams with mercury from the filling. Mercury is bound thereby, and is thus available to a lesser degree, or not at all, for lamp operation. In the lamp according to the invention, the intermediate layer repelling alkali metals prevents alkali metals from reaching the protective layer. The mercury consumption is partly caused by mercury being bound also in other locations than the discharge vessel wall. Wet-chemical analysis of lamps with electrodes has demonstrated that approximately 150 μg mercury is lost in locations other than at the wall during 5000 hours of operation. The effect of the measure according to the invention on the total mercury consumption is accordingly relatively greatest in lamps whose discharge vessels have a comparatively large internal surface area. The measure according to the invention is of particular importance for highly loaded lamps, i.e. lamps having a wall load of 500 W/m$^2$ and higher. Without a layer which repels alkali metals, a comparatively strong diffusion of alkali metals through the protective layer can occur under the influence of the temperatures prevailing in such lamps.

In an attractive embodiment, the intermediate layer which repels alkali metals is made of silicon oxide. Silicon oxide forms a very good barrier against alkali metal ions. The manufacture of the lamp is comparatively simple. It suffices to flush the inner surface of the discharge vessel with a solution of tetraethyl orthosilicate, after which the silicate remaining on the surface hydrolyses in the air. The protective layer may be provided immediately afterwards. A heat treatment is favourable for increasing the density of the layer repelling alkali metals. The heat treatment may coincide with a heat treatment for the protective layer. If a separate heat treatment is unnecessary also for the protective layer, and if a luminescent layer is provided in the lamp in the form of a suspension of luminescent material, the heat treatment of the layer repelling alkali metals may be combined with the heat treatment for driving auxiliary substances such as binders from the suspension.

A layer which repels alkali metals may alternatively be obtained in that the inner surface of the discharge vessel is treated with an acid such as citric acid. This removes sodium, potassium, and other light ions from the inner surface of the discharge vessel, a layer being created thereby in which the concentration of said ions in a direction towards the inner surface decreases gradually, so that a layer of mainly silicon oxide remains adjacent the surface. A heat treatment for increasing the density of the layer is favourable also in this case.

It is noted that U.S. Pat. No. 3,544,828 discloses a low-pressure mercury vapour discharge lamp in which the surface of the discharge vessel facing towards the discharge space is provided with a silicon oxide layer which repels alkali metals. The layer is obtained in that a polyorganosiloxane resin, for example polymethyl siloxane, dissolved in an organic solvent, for example butanol, is provided against the inner surface, the layer is dried, whereby polymerization takes place, and the layer is oxidized. Although the layer repelling alkali metals contributes to lumen maintenance during lamp life, the reduction in the mercury consumption is only limited. In this lamp, which has no protective layer, comparatively much mercury available for lamp operation is lost because mercury atoms are partly bound by the layer repelling alkali metals and, after diffusion through the layer repelling alkali metals, partly form amalgams with alkali metals originating from the glass wall.

In the lamp according to the invention, the protective layer and the intermediate layer repelling alkali metals cooperate. On the one hand, the protective layer prevents mercury from reaching the layer repelling alkali metals. On the other hand, the layer repelling alkali metals hampers the diffusion of alkali metals towards the protective layer. Absorption of mercury in the layer repelling alkali metals and amalgamation with alkali metals are thus counteracted, so that the mercury consumption is considerably reduced. It is essential for the protective layer and the intermediate layer repelling alkali metals to be present in the order mentioned above. If the protective layer were present between the surface of the discharge vessel and the layer repelling alkali metals, there would be no cooperation between the protective layer and the layer repelling alkali metals.

The intermediate layer repelling alkali metals and the protective layer may be formed, for example, from an organic metal compound which is dissolved in an organic solvent. Alternatively, the protective layer and/or the layer repelling alkali metals may be obtained from an aqueous solution or suspension of a metal compound.

An attractive embodiment of the low-pressure mercury vapour discharge lamp according to the invention is characterized in that the intermediate layer repelling alkali metals has a coating weight which lies between 5 $\mu g/cm^2$ and 250 $\mu g/cm^2$. On the one hand, a sufficient thickness of the intermediate layer is safeguarded then in spite of any local thickness variations which occur in practice. On the other hand, the intermediate layer is not so thick then that special measures are required for preventing cracks arising in the intermediate layer during its formation. In an attractive embodiment of the lamp, the coating weight of the protective layer lies between 10 $\mu g/cm^2$ and 250 $\mu g/cm^2$ for similar reasons.

In an attractive embodiment of the lamp according to the invention, the protective layer comprises at least an oxide of at least one element from the group formed by scandium, yttrium, lanthanum, gadolinium, ytterbium, and lutetium. Oxides of these metals are comparatively well permeable to UV radiation, and are accordingly very suitable for lamps without luminescent layers such as lamps for disinfection purposes and lamps with an UV-emitting layer such as sun couch lamps.

For lamps for general lighting purposes, where the radiation generated in the discharge space is converted into visible radiation by a luminescent layer, a particular embodiment is also favourable wherein the protective layer comprises titanium oxide and/or zirconium oxide. The use of oxides of these metals in such lamps has the advantage that they absorb radiation of a wavelength below 350 nm comparatively strongly. This counteracts that any UV radiation not converted by the luminescent layer could reach the wall. UV radiation can adversely affect the transmissivity of glass.

Very favourable results are achieved in an embodiment in which the protective layer is composed from particles having an average diameter which lies between 10 and 100 nm and the protective layer has a coating weight of at least 25 $\mu g/cm^2$. The particles may be provided on the layer repelling alkali metals in the form of a suspension. A good adhesion to the layer repelling alkali metals is obtained owing to the comparatively small dimensions of the particles, also without a heat treatment.

In a favourable modification of this embodiment, the protective layer is made of aluminium oxide particles. Although the initial mercury consumption is comparatively high with such a protective layer, the mercury consumption is comparable to or even considerably lower than that found with the use of, for example, an yttrium oxide layer in the longer term, for example after 500 hours of operation.

It is noted that it is of no importance for the measure according to the invention whether the discharge is maintained by means of a pair of electrodes arranged in the discharge space or by alternative means, such as a coil, for example enclosed in a recess of the discharge vessel.

An embodiment of a low-pressure mercury vapour discharge lamp according to the invention is explained in more detail with reference to the drawing. The FIGURE therein diagrammatically shows a lamp in longitudinal sectional view.

The low-pressure mercury vapour discharge lamp shown in the FIGURE comprises a light-transmitting, lime glass discharge vessel 10 which encloses a discharge space 11 which is provided with a filling 12 of 500 μg mercury and a rare gas. The discharge vessel 10 has a length of 120 cm and an internal diameter of 2.5 cm. A protective layer 14 of at least an oxide of at least one element from the series formed by magnesium, aluminium, titanium, zirconium, and the rare earths lies on a surface 13 of the discharge vessel facing towards the discharge space 11. The protective layer 14 in this case is formed by a film-type, substantially closed layer of yttrium oxide with a coating weight of 20 $\mu g/cm^2$. Since the layer is a kind of film, it is substantially free from particles greater than 1 μm. The lamp in addition has means 20 for maintaining an electrical discharge in the discharge space 11, here in the form of electrodes 21*a*, 21*b* arranged opposite one another in the discharge space 11. A layer 15 repelling alkali metals is present between the surface 13 of the discharge vessel 10 facing towards the discharge space 11 and the film-type protective layer 14. The intermediate layer 15 repelling alkali metals is formed by a silicon oxide layer with a coating weight of 8 $\mu g/cm^2$. A luminescent layer 16 with a coating weight of 3 $mg/cm^2$ is provided on the protective layer 14, in the embodiment shown composed from green-luminescing cerium-magnesium aluminate activated by terbium (CAT), blue-luminescing barium-magnesium aluminate activated by bivalent europium (BAM), and red-luminescing yttrium oxide activated by trivalent europium (YOX). In an alternative embodiment of the lamp according to the invention, a luminescent layer is absent. This embodiment of the lamp is suitable, for example, as a UV radiator for disinfection purposes.

Five lamps according to the embodiment (AB) of the invention described with reference to the FIGURE and five lamps not according to the invention (BB) were manufactured, the discharge vessel in the latter case having exclusively a protective layer with a coating weight of 40 $\mu g/cm^2$. The discharge space of each of these lamps contains 500 μg mercury. Five lamps (BA) were also manufactured where the protective layer was provided between the inner surface of the discharge vessel and the layer repelling alkali metals. The layer repelling alkali metals and the protective layer of these lamps (BA) have a coating weight of 8 and 20 $\mu g/cm^2$, respectively. The lamps were dosed with 1000 μg mercury.

The layer repelling alkali metals was obtained in lamps AB and BA in that the surface of the discharge vessel facing towards the discharge space was flushed with a solution of tetraethyl orthosilicate and hydrochloric acid in ethanol, after which the discharge vessel was dried. A protective layer was formed in lamps AB, BB, and BA in that a solution of yttrium acetylacetonate in a mixture of butylacetate and butanol was flushed over the inner surface of the discharge vessel. Alternatively, the protective layer may be obtained by means of an aqueous solution. The protective layer was dried and subsequently sintered. As a last step, a luminescent layer was provided in usual manner in the form of a suspension of luminescent materials, after which the luminescent layer was dried and subjected to a heat treatment in order to drive out auxiliary substances present in the luminescent layer, such as binders.

Lamps AB, BB, and BA were subjected to an endurance test. During the endurance test, the lamps were operated in series with an inductive ballast at a frequency of 50 Hz. The test was interrupted after 100, 500 and 1000 hours for measuring the mercury consumption of the lamps. During the measurement, the lamps were operated at an alternating DC voltage. The test results are given in Table 1. The measuring method used was based on the phenomenon that free mercury in a DC-operated lamp moves to the negative electrode. The mercury displacement is visible in the form of a decrease in intensity of the light radiated by the lamp adjacent the end with the positive electrode. In the implementation of the measuring method during the test, the polarity of the DC voltage is reversed the moment the luminous intensity adjacent the end with the positive pole has dropped to 60% of the rated value. The time which elapses between this moment and the moment the luminous intensity adjacent the opposite end has dropped to 60% of the rated value is a measure for the quantity of free mercury still available, and thus for the mercury consumption. The measuring method was calibrated by means of results obtained with a wet-chemical analysis.

TABLE 1

| | Mercury consumption (in μg) in type AB, BA, and BB lamps during an operating period T (in hours) | | |
|---|---|---|---|
| T(h) | AB | BA | BB |
| 100 | 110 | 718 | 142 |
| 500 | 180 | — | 290 |
| 1000 | 253 | — | 380 |

Although the intermediate layer repelling alkali metals is comparatively thin compared with the protective layer, it is found from the measurements that the lamps (AB) provided with a protective layer in combination with an intermediate layer repelling alkali metals and arranged between the surface of the discharge vessel facing towards the discharge space and the protective layer show a comparatively low mercury consumption compared with the lamps (BB) with a protective layer only. A very high mercury consumption occurs by contrast in the lamps (BA) where the layer repelling alkali metals lies on the protective layer. Substantially all the mercury present in the lamp had already been used up in the period between 100 and 500 hours of operation.

Similar lamps (I) according to the invention were manufactured for a further endurance test, this time having a protective layer of zirconium oxide with a coating weight of 22 $\mu g/cm^2$ on an intermediate layer repelling alkali metals and made of silicon oxide with a coating weight of 15 $\mu g/cm^2$. The coating weight of the luminescent layer was 3 $mg/cm^2$. For comparison, lamps (II) were manufactured with exclusively a protective layer of zirconium oxide having a coating weight of 22 $\mu g/cm^2$. In either case, the zirconium oxide layer was provided in the form of an aqueous solution based on zirconyl nitrate. The discharge space was provided with a filling of 1 mg mercury and a rare gas. The mercury consumption of the lamps was measured after 100 and 500 hours of operation. The results are given in Table 2. The consumption in the period from 100 to 500 hours of operation is also given in the Table.

TABLE 2

| | Mercury consumption in μg in type I and II lamps during an operational period of T hours, and mercury consumption in the period from 100 to 500 hours. | |
|---|---|---|
| T(h) | I | II |
| 100 | 73 | 65 |
| 500 | 232 | 377 |
| 100–500 | 159 | 312 |

Although the type I and II lamps have approximately the same mercury consumption in the short term (100 hours), the mercury consumption of the lamps according to the invention (I) is considerably smaller in the longer term (500 hours). The mercury consumption in the period from 100 to 500 hours is reduced by approximately a factor two by the measure according to the invention.

Similar lamps (I) according to the invention were manufactured for a further endurance test, now with a protective layer of aluminium oxide and an intermediate layer of silicon oxide for repelling alkali metals. The intermediate layer repelling alkali metals was provided by flushing the surface facing towards the discharge space with a solution of 4.1% by volume of tetraethyl orthosilicate and 3% by volume 1N hydrochloric acid in ethanol, after which the silicate remaining on the surface was hydrolysed in air. The aluminium oxide layer was then provided as a suspension of Alon-C particles. The suspension was prepared through homogeneization of a mixture of 50 g Alon-C from Degussa with 6 ml acetic acid as a stabilizer in 500 mg water during 24 hours in a vessel with steatite balls on a roller table. After this, another 80 ml water and 16 ml of the flow promoter Antarox were added to the suspension. The suspension of aluminium oxide particles remaining on the silicon oxide layer after flushing was subsequently dried, after which a luminescent layer was provided in usual manner in the form of a suspension of luminescent materials. The lamp was then subjected to a heat treatment for driving out any auxiliary substances present in the aluminium oxide and in the luminescent layer. The protective layer and the intermediate layer had respective coating weights of 60 $\mu g/cm^2$ and 15 $\mu g/cm^2$. The luminescent layer had a coating weight of 3 $mg/cm^2$. For comparison, lamps (II) not according to the invention were manufactured, having a protective layer of aluminium oxide only with a coating weight again of 60 $\mu g/cm^2$. 400 μg mercury was dosed in all cases. The mercury consumption is shown in Table 3.

TABLE 3

| | Mercury consumption (in μg) in type I and II lamps during an operating time of T hours. | |
|---|---|---|
| T(h) | I | II |
| 100 | 136 | 167 |
| 500 | 171 | 245 |
| 1000 | 200 | 291 |

It is apparent also from this endurance test that the lamp according to the invention has a relatively low mercury consumption compared with a lamp having a protective layer only.

We claim:

1. A low-pressure mercury vapour discharge lamp comprising a radiation-transmitting glass discharge vessel which encloses a discharge space in a gastight manner and which is provided with a filling of mercury and a rare gas, while a protective layer comprising at least an oxide of at least one element from the series formed by magnesium, aluminum, titanium, zirconium, and the rare earths is provided at a surface of the discharge vessel facing towards the discharge space, which protective layer is substantially free from particles greater than 1 μm, while the lamp further comprises means for maintaining an electrical discharge in the discharge space, characterized in that an intermediate layer which repels alkali metals is present between the surface of the discharge vessel facing towards the discharge space and the protective layer, and in that the protective layer has a coating weight which lies between 10 $\mu g/cm^2$ and 250 $\mu g/cm^2$.

2. A low-pressure mercury vapour discharge lamp as claimed in claim 1, characterized in that the protective layer comprises at least an oxide of at least one element from the group formed by scandium, yttrium, lanthanum, gadolinium, ytterbium, and lutetium.

3. A low-pressure mercury vapour discharge lamp as claimed in claim 1, characterized in that the protective layer comprises titanium oxide or zirconium oxide.

4. A low-pressure mercury vapour discharge lamp as claimed in claim 1, characterized in that the protective layer is made of aluminium oxide.

5. A low-pressure mercury vapour discharge lamp as claimed in claim 1, characterized in that the lamp is in addition provided with a luminescent layer between the protective layer and the discharge space.

6. A low-pressure mercury discharge lamp as claimed in claim 1, characterized in that the intermediate layer which repels alkali metals is made of silicon oxide.

7. A low-pressure mercury vapour discharge lamp comprising a radiation-transmitting glass discharge vessel which encloses a discharge space in a gastight manner and which is provided with a filling of mercury and a rare gas, while a protective layer comprising at least an oxide of at least one element from the series formed by magnesium, aluminum, titanium, zirconium, and the rare earths is provided at a surface of the discharge vessel facing towards the discharge space, which protective layer is substantially free from particles greater than 1 μm, while the lamp further comprises means for maintaining an electrical discharge in the discharge space, characterized in that an intermediate layer which repels alkali metals is present between the surface of the discharge vessel facing towards the discharge space and the protective layer, and in that the intermediate layer repelling alkali metals has a coating weight which lies between 5 $\mu g/cm^2$ and 250 $\mu g/cm^2$.

8. A low-pressure mercury vapour discharge lamp as claimed in claim 2, characterized in that the protective layer comprises titanium oxide or zirconium oxide.

9. A low-pressure mercury vapour discharge lamp as claimed in claim 7, characterized in that the protective layer comprises at least an oxide of at least one element from the group formed by scandium, yttrium, lanthanum, gadolinium, ytterbium, and lutetium.

10. A low-pressure mercury discharge lamp as claimed in claim 7, characterized in that the intermediate layer which repels alkali metals is made of silicon oxide.

11. A low-pressure mercury vapour discharge lamp as claimed in claim 7, characterized in that the lamp is in addition provided with a luminescent layer between the protective layer and the discharge space.

12. A low-pressure mercury vapour discharge lamp as claimed in claim 7, characterized in that the protective layer is made of aluminum oxide.

13. A low-pressure mercury vapour discharge lamp comprising a radiation-transmitting glass discharge vessel which encloses a discharge space in a gastight manner and which is provided with a filling of mercury and a rare gas, while a protective layer comprising at least an oxide of at least one element from the series formed by magnesium, aluminum, titanium, zirconium, and the rare earths is provided at a surface of the discharge vessel facing towards the discharge space, which protective layer is substantially free from particles greater than 1 μm, while the lamp further comprises means for maintaining an electrical discharge in the discharge space, characterized in that an intermediate layer which repels alkali metals is present between the surface of the discharge vessel facing towards the discharge space and the protective layer, and in that the protective layer is composed from particles having an average diameter which lies between 10 and 100 nm and the protective layer has a coating weight of at least 25 $\mu g/cm^2$.

14. A low-pressure mercury vapour discharge lamp as claimed in claim 13, characterized in that the lamp is in addition provided with a luminescent layer between the protective layer and the discharge space.

15. A low-pressure mercury vapour discharge lamp as claimed in claim 13, characterized in that the intermediate layer which repels alkali metals is made of silicon oxide.

* * * * *